US005581813A

United States Patent [19]

Henschel

[11] Patent Number: 5,581,813

[45] Date of Patent: Dec. 10, 1996

[54] CAP WITH TRANSPARENT POCKETS

[75] Inventor: Aaron W. Henschel, St. Louis, Mo.

[73] Assignee: Henschel Manufacturing Company, St. Louis, Mo.

[21] Appl. No.: 504,598

[22] Filed: Jul. 20, 1995

[51] Int. Cl.[6] ..... A42B 1/24

[52] U.S. Cl. ..... 2/195.1; 2/209.13; 40/329

[58] Field of Search ..... 2/195.1, 175.1, 2/209.13, 171, 181, 209.12, 247, 181.6; 40/329, 586

[56] References Cited

U.S. PATENT DOCUMENTS

| | | | |
|---|---|---|---|
| 2,803,829 | 8/1957 | Tscharmer | 2/181 |
| 3,765,031 | 10/1973 | Beresic | 2/185 |
| 4,312,076 | 1/1982 | Gamm | 2/199 |
| 4,386,437 | 6/1983 | Fosher | 2/209.13 |
| 4,586,280 | 5/1986 | Dane | 40/329 |
| 4,918,758 | 4/1990 | Rendina | 2/171 |
| 5,111,366 | 5/1992 | Rife et al. | 2/209.13 |
| 5,233,703 | 9/1993 | Galka | 2/209.13 |
| 5,253,368 | 10/1993 | Blake | 2/195.1 |
| 5,276,985 | 1/1994 | Halloran | 2/209.13 |
| 5,410,761 | 5/1995 | Connelly et al. | 2/195.1 |
| 5,452,479 | 9/1995 | Mostert | 2/195.1 |
| 5,465,426 | 11/1995 | Beaton | 2/195.1 |

*Primary Examiner*—Amy B. Vanatta
*Attorney, Agent, or Firm*—Polster, Lieder, Woodruff & Lucchesi

[57] ABSTRACT

One or more transparent pockets for a cap is disclosed. Each such pocket is designed to store and display at least one object. Each pocket is formed on an outside or external head covering portion of the cap. The head covering portion includes a circumferential edge and an outwardly extending brim. One or more transparent panels are secured to the outside or external surface of a segment of the head covering portion along selected peripheral edges for forming each pocket between each transparent panel and the segment. Each transparent panel is secured along its lower peripheral edge in the vicinity of the circumferential edge of the head covering portion. The side peripheral edges of each transparent panel are secured to side peripheral edges of the head covering segment. The upper edge of each panel is unattached from the head covering segment in order that an object can be inserted into or removed from each such pocket by a user.

For certain objects, such as fishing lures, it may be desirable to provide a backing strip within each such transparent pocket adjacent the outside or external surface of the head covering to prevent injury to the head of a user.

4 Claims, 2 Drawing Sheets

CAP WITH TRANSPARENT POCKETS

BACKGROUND OF THE INVENTION

This invention relates to a cap, and in particular a cap having at least one transparent plastic pocket for accommodating and displaying at least one object, such as a P.O.G. bottle cap, a baseball card or even a fishing lure.

Many styles of functional headwear have been patented, particularly for use in various sports, such as baseball, hunting or the like, or for use in conjunction with employment, work or an activity where the headwear has built-in features to facilitate a particular task or job. The present invention is unlike all such aforementioned known headwear of the prior art. One prior art headwear design that appears to be most closely related to the current invention is disclosed in U.S. Pat. No. 4,312,076, issued to Gamm. The Gamm patent discloses a cap with an integral pocket that can be used to store smaller sized personal items, such as keys, coins or paper money. This cap has a decorative panel attached to the front portion of the cap which is removably secured by Velcro, a snap or other like fastening device to the apex of the cap to form a pocket. This panel is used to conceal from view various personal items stored within the pocket for safekeeping by an athlete during participation in a sporting event, or the like.

The cap of the present invention, unlike that disclosed in the Gamm patent, is a form of functional headwear used to display objects contained in one or more transparent pockets arranged around the cap. In particular, the cap of the present invention can be used by children to display baseball or collector's cards or the well-known P.O.G. (papaya-orange-guava) bottle caps or similar collector's pieces produced by SLAM-TEK and other manufacturers or the like which are currently popular collectible items among children. Other items that could be displayed include baseball cards, fishing lures and other items. According to the present invention, at least one transparent panel is attached to the head covering portion of the cap in order that the aforementioned items may be inserted or removed from each such pocket by the user. Additionally, the panel and pocket of the present invention are not secured by a fastening device to the apex of the cap and do not extend to the apex of the cap, as required in the Gamm patent. Thus, the item contained within each transparent pocket are both visible and easily accessible to a user.

SUMMARY OF THE INVENTION

Accordingly, one object of the present invention is to provide a cap having a head covering portion which has at least one transparent panel attached to the head covering portion in such a way to provide a transparent pocket where substantially flat or other objects may be stored and displayed.

Another object of this invention is to provide a pocket for a cap where a segment of the formed cap can function in conjunction with a transparent plastic panel for forming the completed pocket.

Still another object of this invention is to provide a pocket having its upper peripheral edge unattached to the head covering segment of the cap such that substantially flat or even non-flat and other objects can be easily inserted into or removed from the pocket by a user.

Yet another object of this invention is a cap with at least one transparent pocket that is easy to manufacture and cosmetically appealing in appearance.

These and other objects will become apparent to those skilled in the art in light of the following disclosure and accompanying drawings.

In accordance with the invention, generally stated, at least one transparent pocket for a cap is disclosed which is designed to hold at least one object. Each such pocket is formed on a head covering portion of the cap, the head covering portion having a circumferential edge and an outwardly extending brim. For each such pocket, a panel is secured to an external surface of a segment of the head covering portion along selected peripheral edges for forming the pocket between the panel and the segment. The panel is secured generally along its lower peripheral edge adjacent to the circumferential edge of the head covering portion. The side peripheral edges of the panel are secured to the side peripheral edges of the head covering segment. The upper edge of the panel is unattached to the head covering segment, allowing for insertion or removal of one or more objects from each pocket.

Another aspect of the present invention includes a head covering for a hat having a circumferential edge and a brim attached to and extending outwardly generally from the circumferential edge of the head covering where the improvement includes at least one or more transparent plastic panels attached to an outside or external surface of the head covering to define a series hollow pockets. The dimensions of each such panel are defined by its side vertical peripheral edges and its upper and lower horizontal peripheral edges. The improvement also includes the connecting of the side peripheral edges of each panel to the head covering and means for securing the lower edge of each panel to the circumferential edge of the head covering. The upper peripheral edge portion of each panel is unattached to the head covering to permit insertion and removal of at least one object into each pocket between the panel and the head covering as well as to allow for viewing of the object placed in the pocket.

A third aspect of the present invention relates to a cap having a head covering portion with a circumferential edge and a brim extending outwardly generally from the circumferential edge. The improvement includes a transparent panel secured to an external surface of a segment of the head covering portion to form an external pocket where substantially flat items can be stored and displayed. The panel extends upwardly generally from the circumferential edge. The panel has slightly greater overall width and a substantially shorter overall height than the head covering segment. The panel is stitched along its lower peripheral edge generally along the circumferential edge and along its side peripheral edges generally to side peripheral edges of the segment. The upper peripheral edge of the panel is unattached to the head covering segment, allowing for selectively removing or storing the object in the pocket.

Other objects and features will become apparent from the description that follows.

BRIEF DESCRIPTION OF THE DRAWINGS

The objects of the invention are achieved as set forth in the illustrative embodiments shown in the drawings which form a part of the specification.

Corresponding reference characters indicate corresponding parts throughout the several views of the drawings.

DESCRIPTION OF THE PREFERRED EMBODIMENTS

Figure 1:
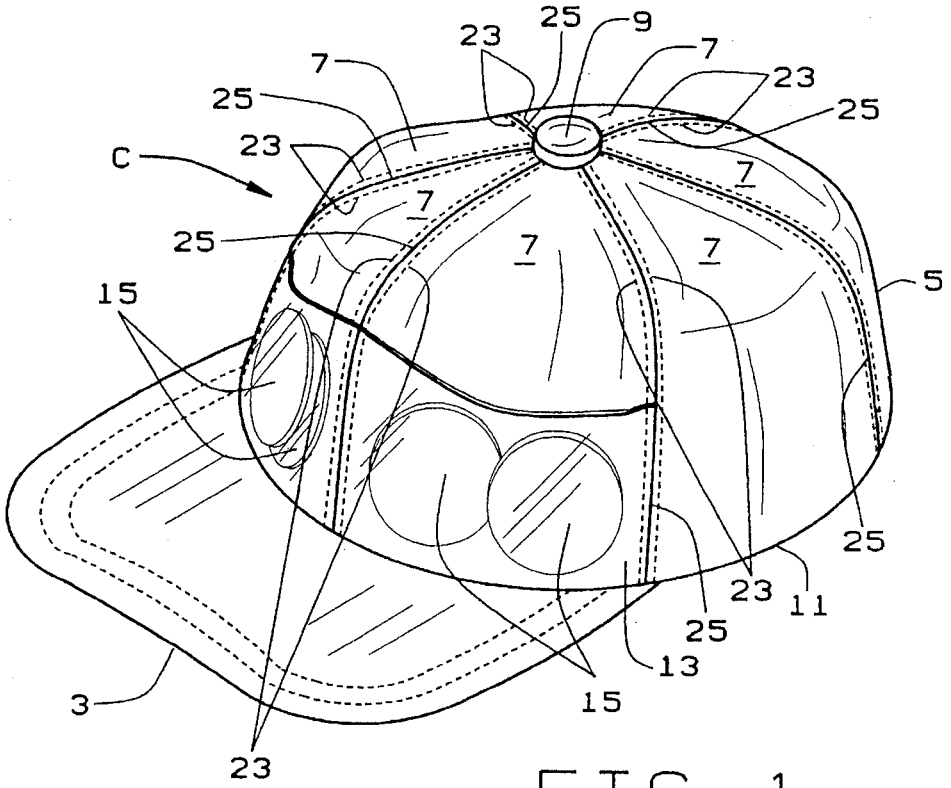
FIG. 1 is a perspective view of the cap of this invention, disclosing two transparent panels attached to the head covering portion above the cap's brim so as to form two pockets each illustrated with two substantially flat objects stored in each pocket.

As illustrated in the drawings, a cap is shown and is indicated generally at C. The cap C includes a head covering portion 5, of typical design, including six equally sized segments 7 extending from a bead 9 located at the apex of the cap C to the circumferential edge 11 of the cap C. A bill or brim 3 extends from the frontal portion of the cap C at its circumferential edge 11.

Figure 5:
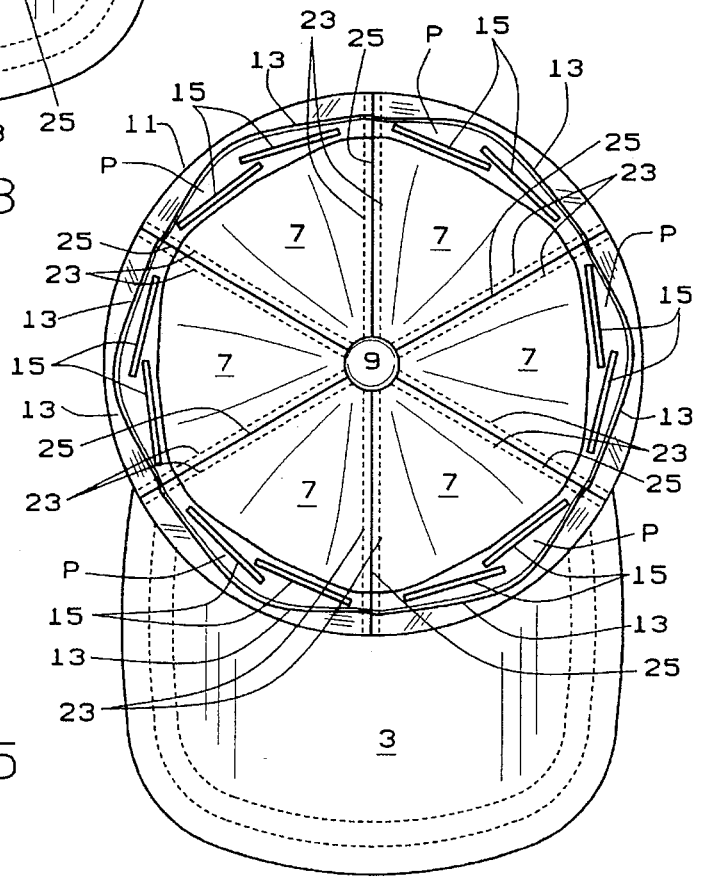
FIG. 5 is a top elevational view of another embodiment of the cap of this invention, disclosing six transparent panels attached to the head covering portion so as to form six pockets with two substantially flat objects being stored in each pocket.

FIG. 1 illustrates two pockets P formed at the location of the frontal portion of the cap C and extending generally upwardly from the circumferential edge 11 of the cap C. The pockets P are provided to accommodate and display substantially objects 15, such as P.O.G. bottle caps, baseball cards, fishing lures and other objects. The maximum number of pockets P which may be present on a cap C preferably corresponds to but is not limited to the number of segments 7 used in construction of the cap C. For the particular cap disclosed in these drawings, up to six pockets may be present on the cap C since six segments 7 are used to construct the head covering 5. FIG. 5 illustrates one embodiment of the present invention where six pockets P are illustrated. However, as will be apparent, a greater or lesser number of pockets may be used, if desired.

Figure 4:
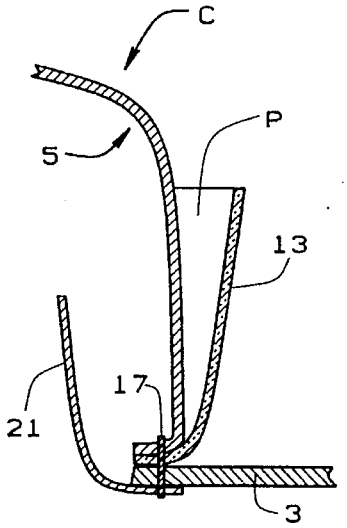
FIG. 4 is a cross-sectional view of the cap taken along line 4—4 in FIG. 3.

Each pocket P is formed by a transparent plastic panel 13 that is attached to the outer or external surface of the head covering portion 5 along selected peripheral edges. More specifically, each panel 13 is secured generally along its lower peripheral edge adjacent to the circumferential edge 11 of the cap C. Side peripheral edges of each panel 13 are connected to side peripheral edges of one segment 7. Each panel 13 has a slightly greater overall width and a substantially shorter overall height than the segment 7. In the preferred embodiment, machine stitching 17 is used to secure each panel 13 to one segment 7 as shown in FIG. 4. The side peripheral edges of the panel 13 are stitched along the seams 25 adjacent each segment 7. The stitched seams 25 bind the side peripheral edges of two adjacent segments 7. The side peripheral edges of each segment 7 are further secured by finishing stitching 23 as shown in FIG. 1. This construction allows the panels 13 to be easily stitched to the head covering 5 during the assembly of the cap C.

Figure 2:
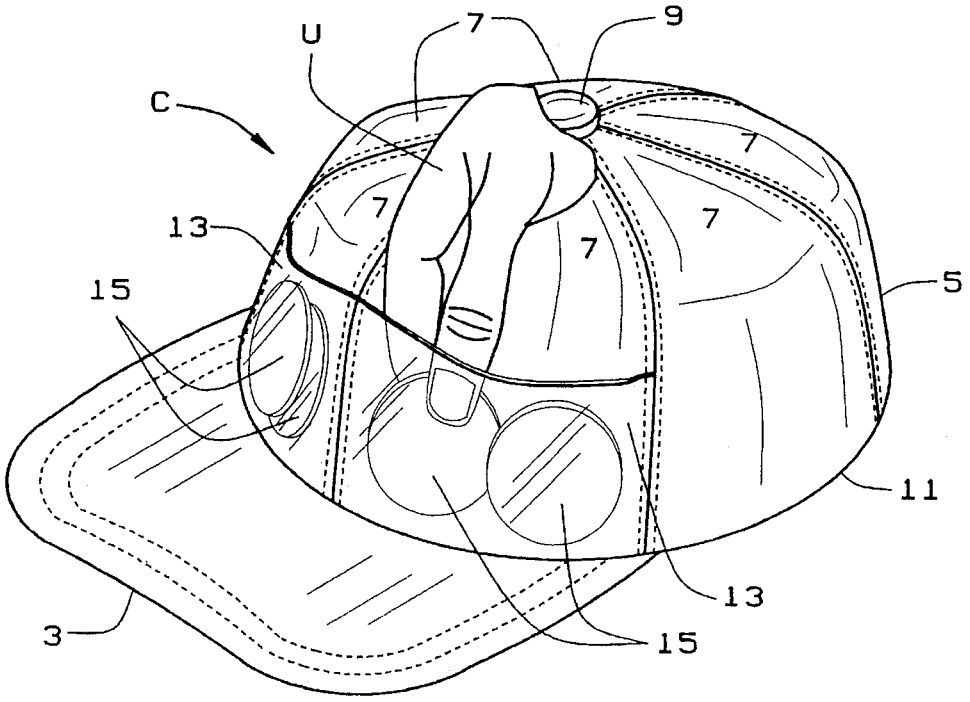
FIG. 2 discloses the cap of FIG. 1 and shows the manner in which the objects may be inserted into or removed from the pockets.
Figure 3:
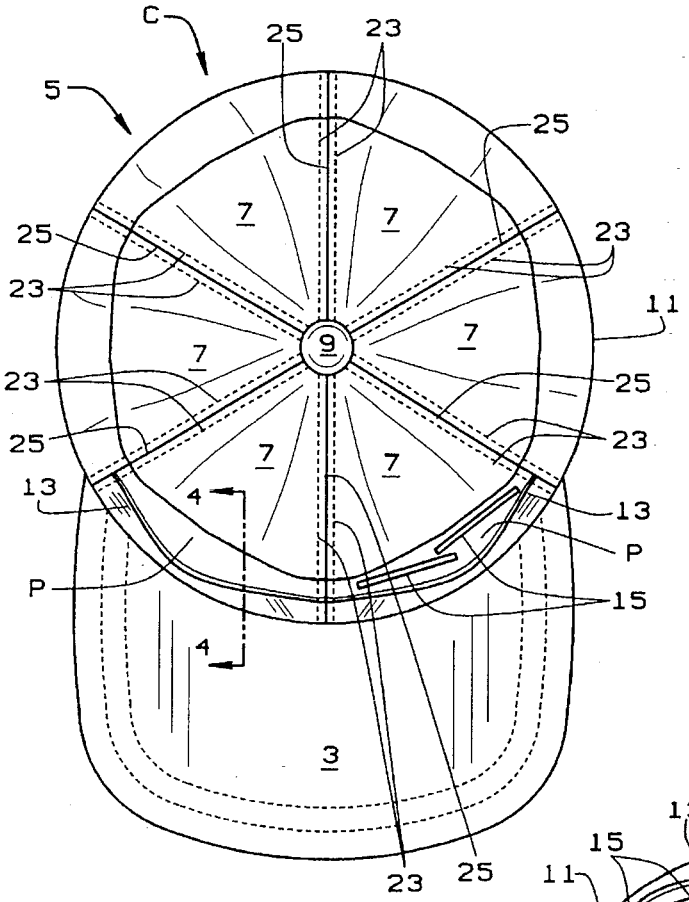
FIG. 3 is a top elevational view of the cap of the present invention illustrating two pockets with two substantially flat objects stored in one pocket.

The upper peripheral edge of each panel 13 is unattached to one segment 7. This allows a user U to selectively insert objects 15 into the pocket P or remove objects 15 from pocket P as shown in FIG. 2. Since each of the panels 13 are transparent, objects 15 may be visibly displayed when stored in pockets P. As illustrated in the drawings, the cap C is shown as having two transparent pockets P (FIG. 3) or six pockets P (FIG. 5) for storing objects 15. However, one to six pockets may be present in a typical cap C, with more or less pockets P, as may be desired.

It will be understood that both P.O.G. bottle caps and baseball cards are substantially flat objects that can be displayed with the hat of the present invention. Also, fishing lures, although not flat, can also be used. This may require the further use of a cardboard or other semi-rigid backing strip that lies adjacent the head covering within each transparent pocket in order to prevent the leader of the fishing lure from penetrating the head covering and injuring the head of a user. Of course, other types of objects may be used with the hat of the present invention, as well.

The foregoing description is set forth only for illustrative purposes only and is not meant to be limiting. Numerous variations, within the scope of the appended claims will be apparent to those skilled in the art in light of the foregoing description and accompanying drawings.

Having thus described the invention, what is claimed and desired to be secured by Letters Patent is:

1. In a cap having a head covering portion and an outwardly extending brim, the improvement comprising at least one transparent plastic panel having spaced generally vertically directed side edges and spaced generally horizontally directed upper and lower edges, each said panel being secured along its spaced side edges and lower edge to said head covering and the upper edge of each panel being unattached to provide a transparent plastic pocket for visible storage and removal of objects, and a non-penetrating semi-rigid back-up strip within the transparent plastic pocket adjacent an external surface of the head covering, said non-penetrating semi-rigid back-up strip having sufficient non-penetrating strength to prevent penetration of the head covering and injury to the head of a user from a penetrating type object placed in the transparent plastic pocket.

2. The improvement as defined in claim 1 including at least one transparent plastic pocket being secured to said head covering in the vicinity of and spaced upwardly from said brim.

3. The improvement as defined in claim 1 including a plurality of transparent pockets secured and peripherally spaced about the head covering.

4. The improvement as defined in claim 3 including a backup strip positioned in each such transparent pocket.

* * * * *